United States Patent [19]

Bergmann et al.

[11] Patent Number: 4,746,169

[45] Date of Patent: May 24, 1988

[54] APPARATUS FOR EXCAVATING PASSAGES

[75] Inventors: Kurt Bergmann, Vienna; Konrad Schoen, Kapfenberg, both of Austria; Udo Wenzel, Essen, Fed. Rep. of Germany

[73] Assignee: Vereinigte Edelstahlwerke AG, Vienna, Austria

[21] Appl. No.: 864,848

[22] Filed: May 20, 1986

[30] Foreign Application Priority Data

May 23, 1985 [AT] Austria ..... 1560/85

[51] Int. Cl.[4] ..... E21D 23/00

[52] U.S. Cl. ..... 299/33; 405/259

[58] Field of Search ..... 299/31, 33; 405/303, 405/259

[56] References Cited

U.S. PATENT DOCUMENTS

| | | | |
|---|---|---|---|
| 3,640,573 | 2/1972 | Safar | 299/31 |
| 3,643,999 | 2/1972 | Kampf-Emden et al. | 299/31 |
| 4,371,211 | 2/1983 | Snyder | 299/31 X |

FOREIGN PATENT DOCUMENTS

| | | | |
|---|---|---|---|
| 1807972 | 6/1970 | Fed. Rep. of Germany | 299/31 |
| 1807971 | 6/1970 | Fed. Rep. of Germany | 299/31 |

*Primary Examiner*—Stephen J. Novosad
*Assistant Examiner*—Bruce M. Kisliuk
*Attorney, Agent, or Firm*—Werner W. Kleeman

[57] ABSTRACT

The apparatus for excavating passages such as tunnels, shafts and the like, is continually and/or intermittently movable in a predetermined driving direction and contains at least one boring head, possibly, a multipart boring head. In its operative position, the boring head substantially covers the cross-section of the passage to be excavated. The boring head is constructed so as to be thrust or pressed by means of fluid-operated cylinders, tooth racks or the like against the face to be excavated. The apparatus possesses one or a number of drive units for the boring head and at least one device for removing the excavated material. There are further provided a support device for supporting the boring head in the passage and at least one drilling mount possessing a bore motor and a thrust motor for drilling anchor holes and/or blast holes and/or for placing anchors transversely to a predetermined driving direction. When viewed in the driving direction, the drilling mount is located forwardly of the boring head, preferably between the boring head support device and the boring head. At least one, if desired, two drilling mounts possessing a bore motor and a thrust motor, mounted at a carrier which can be rotationally and positionally fixed substantially relative to the driving direction, especially substantially relative to the passage lengthwise axis. Preferably the drilling mounts are pivotable and/or displaceable in a drilling direction defined by the drilling mounts, especially by means of fluid-operated cylinders.

20 Claims, 2 Drawing Sheets

APPARATUS FOR EXCAVATING PASSAGES

BACKGROUND OF THE INVENTION

The present invention broadly relates to a new and improved construction of an apparatus for excavating passages such as tunnels, shafts and the like.

In its more particular aspects, the present invention specifically relates to an apparatus for excavating passages such as tunnels, shafts, or the like and possessing at least one boring head which, in its operative position, substantially covers the cross-section of the passage to be excavated.

In order to insure a most rapid possible boring progress, such apparatuses also in general possess associated material removing means permitting a substantially continuous boring and excavating operation. However, for safety reasons it is required that appropriate supporting or bracing structures must be provided in the working or excavated space before any personnel may enter the passage or tunnel. In this respect it is already known to arrange a drilling mount together with a drilling machine between the boring head support means and the boring head. Using such arrangement there can be placed at least in the arch or roof region, for example, expandable anchors or cemented anchors. However, the drilling mount is substantially arranged in a fixed angular position so that only a series of consecutive anchors can be mounted in the driving direction. Such a series of anchors offers some safety, however, anchoring of this type will be insufficient particularly in the case of friable rock.

SUMMARY OF THE INVENTION

Therefore, with the foregoing in mind, it is a primary object of the present invention to provide a new and improved construction of an apparatus for excavating passages such as tunnels, shafts or the like and which apparatus does not exhibit the aforementioned drawbacks and shortcomings of the prior art constructions.

Another and more specific object of the present invention aims at providing a new and improved construction of an apparatus for excavating passages such as tunnels, shafts or the like and which apparatus permits drilling of bores, for example, for blast holes or anchor holes and for setting anchors, substantially in radial direction and in all directions transversely to the driving direction of the apparatus.

Yet a further significant object of the present invention aims at providing a new and improved construction of an apparatus for excavating passages such as tunnels, shafts or the like and which apparatus is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present development is manifested by the features that, the apparatus is continually and/or intermittently moveable in a predetermined axial driving direction and contains at least one boring head, possibly, a multipart boring head. In its operative position, the boring head substantially covers the cross-section of the passage to be excavated. The boring head is constructed so as to be thrust or pressed in the predetermined axial driving direction by means of fluid-operated cylinders, tooth racks or the like against the face to be excavated. The apparatus possesses one or a number of drive units axially for driving the boring head and removing means for removing the excavated material. There are further provided support means for supporting the boring head in the passage and at least one drilling mount possessing a bore motor and a thrust motor for drilling anchor holes and/or blast holes and/or for placing anchors transversely to the predetermined axial driving direction. When viewed in the axial driving direction, the drilling mount is located forwardly of the boring head, preferably between the boring head support means and the boring head. At least one or, if desired, two drilling mounts possessing such bore motor and thrust motor are mounted at a carrier which can be rotationally and positionally fixed substantially relative to the predetermined axial driving direction, especially substantially relative to the lengthwise or longitudinal axis of the passage. Preferably, the drilling mounts are pivotable and/or displaceable in a drilling direction defined by the drilling mounts, especially by means of fluid-operated cylinders.

Due to the fact that at least one drilling mount is mounted at a carrier which can be rotationally and positionally fixed and which can be rotated about the predetermined axial driving direction, the at least one drilling mount including the bore motor and the thrust motor substantially may assume any desired position. Consequently, if necessary, corresponding anchors can be arranged even in the bottom area of floor of the passage or the like. Anchors in the bottom area or floor may be required when a plurality of tunnels are arranged above each other or when anchoring is required to surround shafts for safety reasons. Furthermore, blast holes can be placed, for example, for transverse tunnels and transverse shafts. Thereafter and after the carrier has been rotated into a position corresponding to the desired location of the drilling mount, the drilling mount is displaced toward the surface or wall of the tunnel and supported thereat by a mandrel or the like, or rotated into the required position. An exact preparation of the drilling holes is rendered possible by this mode of operation. Simultaneously free rotatability and pivotability of the carrier is insured when the drilling mounts are located in their rest or inoperative position.

The carrier may possess at least two drilling mounts which, when viewed in the predetermined driving direction, are differently spaced from the boring head from one another and possibly, as viewed in such driving direction, enclose an angle in the range of about 45° to about 90°. Using such arrangement, at least two bore holes can be simultaneously drilled in one position of the carrier. These bore holes can be either series-arranged behind one another or may also enclose an angle with each other. Furthermore, it is also conceivable due to the series arrangement in the axial driving direction that, for example, a further drilling mount is arranged at the first carrier by means of a further carrier. The carriers are movable independently of each other.

The carrier may also be mounted at an associated support between the boring head and the boring head support means. Preferably this carrier associated support is movable independently of the boring head and the boring head support means in the predetermined axial driving direction or opposite thereto. There can thus be sunk drilling holes at a related operating speed either in correspondence with the boring drive speed or even independently thereof between the boring head and the boring head support means. A particularly simple and robust embodiment of the apparatus according to the present invention results when the carrier possesses a ring gear for rotating the carrier by means of a pinion.

A particularly steady or stable support of the boring head and conjointly therewith a carrier support which is substantially free of vibrations, results when the boring head is guided, particularly slideably or rollingly guided by the associated drive unit and/or thrust rods which are guided, especially slideably or rollingly guided at the boring head support means.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENT

Figure 1:
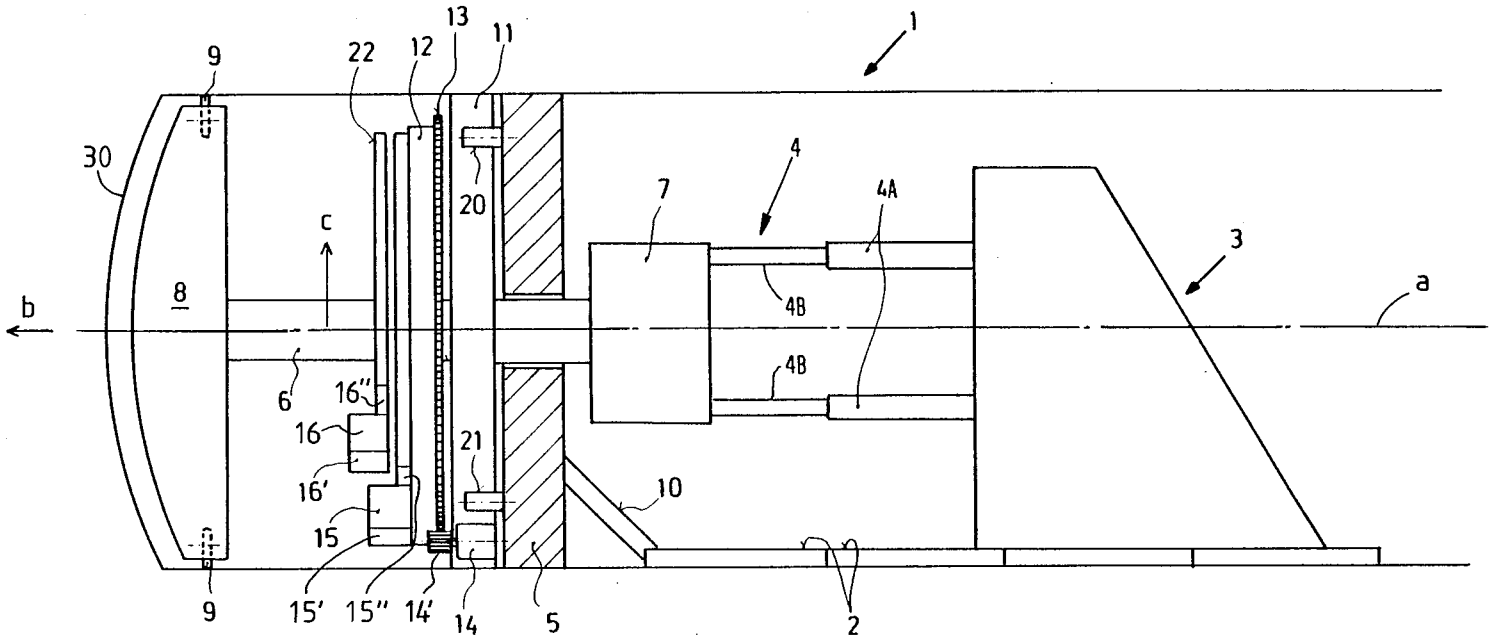
FIG. 1 is a schematic illustration of an exemplary embodiment of the inventive passage excavating, especially tunnel boring apparatus.
Figure 2:
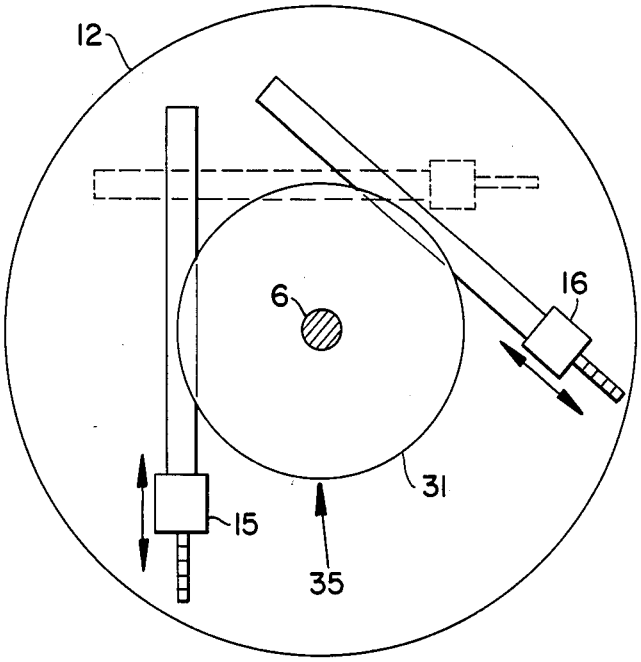
FIG. 2 is a front view of a carrier for drilling mounts in the apparatus shown in FIG. 1.

Describing now the drawing, it is to be understood that to simplify the showing thereof only enough of the structure of the excavating apparatus has been illustrated therein as is needed to enable one skilled in the art to readily understand the underlying principles and concepts of this invention. Turning now specifically to FIG. 1 of the drawings, the passage excavating apparatus illustrated therein by way of example and not limitation will be seen to comprise a tunnel boring apparatus located in a tunnel 1 having a lengthwise passage or tunnel axis a and possessing a substantially circular cross-section having a diameter of, for instance, about 4.5 meters. Feed plates 2 are located on the bottom or floor of the passage or tunnel 1 and can be placed in front of each other corresponding to the boring progress. A stand 3 is releasably connected with and mounted at the feed plates 2. The stand 3 possesses thrust means 4 containing fluid-operated cylinders 4A and thrust rods 4B or equivalent axial drive structure.

A drive shaft 6 for driving at least one boring head 8 which may constitute at least one multipart boring head, is guided in boring head support means 5 which are only schematically illustrated in section. The drive shaft 6 is driven by means of a drive unit 7 which, in turn, can be axially displaced toward a bore or excavation face 30 by the thrust rods 4B of the fluid-operated cylinders 4A. The drive shaft 6 and thereby the drive unit 7 and the boring head 8 is preferably slideably or rollingly guided at the boring head support means 5. Alternatively the thrust rods 4B can be guided, preferably slideably or rollingly guided at the boring head support means 5. The boring head 8 is arranged at the bore or excavation face or end 30 of the tunnel 1 to be excavated. At its outer periphery, this boring head 8 carries wheels 9 for rolling support at the tunnel cross-section or wall.

The excavation now is carried out in such a manner that the drive unit 7 is displaced toward the bore or excavation face 30 by the fluid-operated cylinders 4. The drive unit 7 drives or displaces the boring head 8 and thrusts or presses the boring head 8 in a predetermined axial driving direction b against the bore or excavation face 30 through the drive shaft 6. In its operative position, the boring head 8 substantially covers or extends throughout the cross-section of the passage or tunnel 1. The material excavated during this operation is removed or transported via not particularly illustrated but conventional material removing means to the rear of the stand 3 and transported from there via conveyor belts or the like out of the passage or tunnel 1. When the fluid-operated cylinders 4 are substantially extended, then, the stand 3 is required to be advanced towards the bore or excavation face 30. This is accomplished such that the fixation or connection of the stand 3 to the feed plates 2 is released whereupon the fluid-operated cylinders 4 are actuated. The stand 3 is thereby displaced closer to the bore or excavation face 30. Thereafter, the stand 3 is refixed at the feed plates 2 and the boring head support means 5 is then also forwardly displaced by the fluid-operated cylinders 4 using a not particularly illustrated support. Subsequently a further feed plate 2 is laid or placed on the passage floor in a direction toward the bore or excavation face 30. The boring head support means 5 is then supported again by a bracket or beam 10. The passage excavating or tunnel boring machine then is fully operational again.

In front of the boring head support means 5, a carrier support means or further support 11 is provided. A carrier 12 having a ring gear 13 is rotatably mounted at the carrier support means 11 substantially for rotation about the lengthwise passage or tunnel axis a which coincides with the predetermined axial driving direction b. The carrier 12 is rotatable via an associated motor 14 and a pinion 14'. The motor 14 and pinion 14' constitute pivoting means of positioning means containing the components 14, 14', 20, 21.

The carrier 12 further contains at least one, preferably at least two drilling mounts 15 and 16 including a boring motor, a thrust motor and the like, generally indicated by reference character 15' and 16', respectively, and such drilling mounts 15 and 16 are forwardly arranged of and differently spaced from the boring head 8 as viewed in the predetermined axial driving direction b, i.e. intermediate the boring head 8 and the boring head support means 5. The two drilling mounts 15 and 16 enclose an angle in the range of about 45° to about 90° as viewed in the predetermined axial driving direction b. These two drilling mounts 15 and 16 are series-arranged in axial direction so that, as clearly illustrated in FIG. 1 of the drawings, the two drilling mounts 15 and 16 possess free movability relative to each other. The carrier support means 11 further possesses fluid-operated or hydraulic cylinders 20 and 21 so that this carrier support means 11 can be moved independently of the boring head support means 5. The fluid-operated or hydraulic cylinders 20 and 21 constitute displacement means of the aforementioned positioning means 14, 14', 20, 21 for rotationally and positionally fixing the carrier 12 in preselected positions relative to the predetermined axial driving direction b.

The preparation of drilling holes now is performed such that the drilling mounts 15 and 16 are arranged in a desired mutual angular position at the carrier 12 by appropriately selected mounting means 35 such as, for example, screw-threaded connections or a further carrier 31 which carries one of the two drilling mounts 15 and 16 and which is displaceably mounted at the carrier 12 so that the two drilling mounts 15 and 16 can be adjusted to predetermined angles between themselves preferably in the range of about 45° about 90°. Thereafter, the carrier 12 is brought into the desired angular and axial position whereupon two drill holes, for example, anchor holes and/or blast holes, can be simultaneously drilled in a predetermined drilling direction c which extends substantially transversely to the predetermined axial driving direction b. If further drill holes are desired in other radial directions, the carrier 12 can be rotated via the motor 14 and the pinion 14' and the ring gear 13 into a further position whereafter new drill holes can be sunk or formed. If all drill holes have been made in a related or relevant axial region, the carrier 12 can be forwardly displaced by the fluid-operated or hydraulic cylinders 20 and 21, possibly in a telescopic manner. In this new axial position, further drilling operations can be carried out. The drilling mounts 15 and 16 can also be utilized for setting anchors into anchor holes.

As can be seen from the drawing, the drilling mounts 15 and 16 do not extend to the passage or tunnel surface in their rest or inoperative position but must either be displaced by suitable displacing means like the schematically indicated fluid-operated or hydraulic cylinders 15" and 16" or pivoted toward such passage or tunnel surface so that an associated support mandrel 22 bears upon the passage or tunnel surface or wall in each case. The fluid-operated or hydraulic cylinders or displacing means 15", 16" displace the drilling mounts 15 and 16 in the drilling direction c.

There can also be provided at the carrier 12, drilling mounts 15 and 16 which are arranged parallel to each other and then possess the same spacing from the boring head 8 in axial direction.

While there are shown and described present preferred embodiments of the invention, it is to be distinctly understood that the invention is not limited thereto, but may be otherwise variously embodied and practiced within the scope of the following claims.

What we claim is:

1. An apparatus for excavating passages such as tunnels, shafts, or the like, comprising:

at least one boring head;

said at least one boring head, in its operative position, substantially extending throughout the cross section of the passage to be excavated;

at least one drive unit for driving said boring head;

thrust means for displacing said at least one boring head in a predetermined axial driving direction towards an excavation face of said passage during an excavating operation;

support means supporting said at least one boring head in said passage intermediate said at least one boring head and said at least one drive unit during said excavating operation;

at least one drilling mount for drilling holes substantially transversely to said predetermined axial driving direction;

said at least one drilling mount being arranged intermediate said at least one boring head and said support means supporting said at least one boring head;

at least one carrier carrying said at least one drilling mount and being located intermediate said at least one boring head and said support means supporting said at least one boring head;

said at least one drilling mount being displaceably arranged at said at least one carrier;

mounting means for displaceably mounting said at least one drilling mount relative to said at least one carrier;

positioning means for fixing said at least one carrier in preselected rotational positions relative to said predetermined axial driving direction and said positioning means displacing and fixing said at least one carrier in preselected axial positions relative to said predetermined axial driving direction independent of said at least one drive unit for driving said boring head.

2. The apparatus as defined in claim 1, wherein:

said thrust means contains thrust rods in fluid-operated cylinders.

3. The apparatus as defined in claim 1, wherein:

said at least one drilling mount contains a boring motor and a thrust motor.

4. The apparatus as defined in claim 3, wherein:

said at least one drilling mount contains said boring motor and said thrust motor for drilling anchor holes.

5. The apparatus as defined in claim 4, wherein:

said at least one drilling mount contains said boring motor and said thrust motor for setting anchors in said anchor holes.

6. The apparatus as defined in claim 3, wherein:

said at least one drilling mount contains said boring motor and said thrust motor for drilling blast holes.

7. The apparatus as defined in claim 3, wherein:

said at least one drilling mount contains said boring motor and said thrust motor for drilling anchor holes and blast holes.

8. The apparatus as defined in claim 1, wherein:

said passage defines a lengthwise passage axis substantially extending in said predetermined axial driving direction; and said positioning means fixing said at least one carrier in said preselected rotational positions as well as in said preselected axial positions relative to said lengthwise passage axis.

9. The apparatus as defined in claim 1, wherein:

said positioning means for positioning said at least one carrier contain pivoting means for pivoting said carrier about a predetermined axis.

10. The apparatus as defined in claim 9, wherein:

said at least one carrier contains a ring gear; and said pivoting means containing a pinion meshing with said ring gear of said at least one carrier.

11. The apparatus as defined in claim 1, wherein:

said at least one drilling mount defines a predetermined drilling direction; and displacing means for displacing said at least one drilling mount relative to said at least one carrier in said predetermined drilling direction.

12. The apparatus as defined in claim 11, wherein:

said displacing means contain fluid-operated cylinders.

13. The apparatus as defined in claim 1, wherein:

said at least one drilling mount constitutes at least two drilling mounts;

said at least one carrier carrying said at least two drilling mounts; and said at least two drilling mounts being axially spaced from each other as viewed in said predetermined axially driving direction.

14. The apparatus as defined in claim 13, wherein:

said mounting means adjustably mounts said at least two drilling mounts at a predetermined angle between themselves in the range of about 45° to about 90°.

15. The apparatus as defined in claim 1, further including:

carrier support means for supporting said at least one carrier; and said carrier support means being arranged intermediate said boring head and said boring head support means.

16. The apparatus as defined in claim 15, wherein:

said positioning means for fixing in preselected rotational and axial positions said at least one carrier contain displacement means for displacing said at least one carrier in said predetermined axial driving direction and in a direction opposite thereto;

said displacement means being operatively connected with said carrier support means for supporting said at least one carrier; and said displacement means displacing said carrier support means independently of said boring head and said boring head support means.

17. The apparatus as defined in claim 1, further including:

at least one drive shaft drivingly interconnecting said at least one boring head and said at least one drive unit; and said at least one drive shaft and thereby said at least one boring head and said at least one drive unit is guided at said boring head support means.

18. The apparatus as defined in claim 17, wherein:

said at least one drive shaft is slideably guided at said boring head support means.

19. The apparatus as defined in claim 17, wherein:

said at least one drive shaft is rollingly guided at said boring head support means.

20. An apparatus for excavating passages such as tunnels, shafts, or the like, comprising:

at least one boring head;

said at least one boring head, in its operative position, substantially extending throughout the cross section of the passage to be excavated;

at least one drive unit for driving said boring head;

thrust means for displacing said at least one boring head in a predetermined axial driving direction towards an excavation face of said passage during an excavating operation;

support means supporting said at least one boring head in said passage intermediate said at least one boring head and said at least one drive unit during said excavating operation;

at least two drilling mounts for drilling holes substantially transversely to said predetermined axial driving direction;

said at least two drilling mounts being arranged intermediate said at least one boring head and said support means supporting said at least one boring head;

said at least two drilling mounts being axially spaced from each other as viewed in said predetermined axial driving direction;

at least one carrier carrying said at least two drilling mounts and being located intermediate said at least one boring head and said support means supporting said at least one boring head;

at least one of said at least two drilling mounts being displaceably arranged at said at least one carrier;

mounting means for displaceably mounting said at least one of said at least two drilling mounts relative to said at least one carrier;

positioning means for fixing said at least one carrier in preselected rotational positions relative to said predetermined axial driving direction; and said positioning means displacing and fixing said at least one carrier in preselected axial positions relative to said predetermined axial driving direction independent of said at least one drive unit for driving said boring head.

* * * * *

UNITED STATES PATENT AND TRADEMARK OFFICE

CERTIFICATE OF CORRECTION

PATENT NO. : 4,746,169

DATED : May 24, 1988

INVENTOR(S) : KURT BERGMANN et al

It is certified that error appears in the above-identified patent and that said Letters Patent is hereby corrected as shown below:

Column 5, line 6, after "45°" please insert --to--

Column 5, line 33, after "15" please delete "," (comma) and insert --and--

Signed and Sealed this

Twenty-seventh Day of September, 1988

*Attest:*

DONALD J. QUIGG

*Attesting Officer*

*Commissioner of Patents and Trademarks*